United States Patent [19]

Nakano

[11] Patent Number: 4,730,658

[45] Date of Patent: Mar. 15, 1988

[54] INJECTION METHOD IN A HOT CHAMBER TYPE DIE CASTING MACHINE AND INJECTION APPARATUS FOR CARRYING THE METHOD

[76] Inventor: Akio Nakano, 14-1, Ichikawaminami 3-chome, Ichikawa-shi, Chiba-ken, Japan

[21] Appl. No.: 934,690

[22] Filed: Nov. 25, 1986

[30] Foreign Application Priority Data

Nov. 26, 1985 [JP] Japan ..... 60-266806
Nov. 30, 1985 [JP] Japan ..... 60-270481

[51] Int. Cl.[4] ..... B22D 17/04

[52] U.S. Cl. ..... 164/113; 164/303; 164/312

[58] Field of Search ..... 164/113, 119, 303–318; 425/585, 586, 557, 558

[56] References Cited

U.S. PATENT DOCUMENTS 2,137,764 11/1938 Wagner ..... 164/313

FOREIGN PATENT DOCUMENTS 720066 3/1942 Fed. Rep. of Germany ..... 164/314
1175392 8/1964 Fed. Rep. of Germany ..... 164/312

*Primary Examiner*—Nicholas P. Godici
*Assistant Examiner*—Richard K. Seidel
*Attorney, Agent, or Firm*—Popper, Bobis & Jackson

[57] ABSTRACT

The present invention relates to an injection method and apparatus for carrying out the method in a hot chamber type die casting machine for injecting and filling melting metal or so-called molten metal stored in a retaining furnace into a mold in a system of a thermally pressurizing chamber to cast and mold metal products, wherein brought into communication with a drawing-up cylindrical body stood upright with a lower opened end dipped into the retaining furnace is an injection cylindrical body with one opened end connected to a sprue of a mold to form a cross-shape sleeve, by which molten metal within the retaining furnace is drawn up outside the retaining furnace by a suction force, and the thus drawn-up molten metal is injected and filled into the mold by a pressing force.

5 Claims, 5 Drawing Figures

INJECTION METHOD IN A HOT CHAMBER TYPE DIE CASTING MACHINE AND INJECTION APPARATUS FOR CARRYING THE METHOD

FIELD OF THE INVENTION

This invention relates to a hot chamber type die casting machine, and more specifically to an injection method in a hot chamber type die casting machine for filling a mold with melting metal, a so-called molten metal, which is stored within a retaining furnace, to cast and mold a metal product, and an injection apparatus for carrying out the method, and particularly to an injection method in a hot chamber type die casting machine which uses high temperature molten metal having a pouring temperature of 600° to 1650° C. or so and an injection apparatus for carrying out the method.

DESCRIPTION OF THE PRIOR ART

In a conventional injection method in a hot chamber type die casting machine of the type as described above, as shown in FIG. 5, a plunger tip $d_1'$ of an injection cylinder D' is vertically slidably inserted into a sleeve A' dipped into molten metal within a heat retaining ladle $b_1'$ of a retaining furnace B' hung and held within a machine frame $b_2'$. Molten metal enters the sleeve A' or a so-called pressurized chamber and is pressurized and extruded by reciprocation (downward movement) of the plunger tip $d_1'$. The thus extruded molten metal is fed under pressure to a nozzle 2 connected to a sprue **1*b* of a mold 1 through a passageway 20, and the molten metal is injected into and filled in the mold 1 or a so-called cavity from the nozzle 2**.

However, according to the above-described method, pressure is applied into the sleeve A' from above by the plunger tip $d_1'$ to feed the molten metal under pressure to inject into and fill the mold 1 with molten metal. Therefore, shocks and vibrations from above, produced when the plunger tip $d_1'$ moves forward (during processing) are transmitted to walls of the heat retaining ladle $b_1'$ suspended in midair within the machine frame $b_2'$, suspended edge portions thereof and the like, which entails a fatal drawback in that metallic fatigue such as cracks greatly grows under the influence of the vibrations repeatedly received by the said portions during operation of the die casting machine to possibly damage the said portions, thus disabling to serve for a long period of time.

In addition, the heat retaining ladle $b_1'$ of the retaining furnace B' is generally made of heat resisting metal such as molybdenum steel, cast iron or the like, and therefore susceptible to great thermal shocks from the high temperature molten metal of temperatures from 600° C. to 1650° C. or so, which poses a drawback of lower heat and shock resistance. Therefore, the ladle has been required to be repaired or replaced in a short period of time. At the same time, since the ladle is made of metal, an amount of heat radiation to the outside is so great as to make it difficult to control the temperature of the molten metal.

Furthermore, the sleeve A' dipped into the molten metal in the heat retaining ladle $b_1'$ is also generally made of the above-described heat resisting metal, and is being dipped into the molten metal, as a consequence of which the ladle is always in a high temperature state. Therefore, the sleeve is poor in heat and shock resistance and susceptible to a severe wear caused by the reciprocating plunger tip $d_1'$.

In view of the foregoing, a die casting apparatus as shown in FIG. 2 of Japanese Patent Application Laid-Open No. 5139/1980 in order to solve these problems as noted above has been proposed. In this die casting apparatus, in order to obtain the retaining strength of the heat retaining ladle with respect to the shock and vibration from above during forward movement (during pressurization) of the plunger tip, granular ceramics are filled between the outer surface of the ladle and the inner surface of the machine frame. However, because of the granular ceramics, it was not possible to provide an arrangement enough to protect the ladle from the shock and vibration, which has not beem satisfactory.

The aforesaid patent further provides an arrangement wherein a ceramics coating agent is coated on the inner surfaces of the heat retaining ladle to form a ladle wall into a metal will and a ceramics wall to provide a double wall construction having an excellent heat and shock resistance. However, the ceramics wall is liable to break due to a significant difference in the coefficient of thermal expansion between metal and ceramics.

OBJECTS AND SUMMARY OF THE INVENTION

Accordingly, it is an object of the present invention to avoid application of shocks and vibrations, particularly shocks and vibrations from above to a retaining furnace when molten metal is injected into a mold.

It is a further object of the present invention to provide a construction of a retaining furnace which can impart sufficient rigidity and high heat retaining property to shock resistance, thermal shock resistance, durability and the like.

Other objects will be apparent from the ensuing detailed description and drawings.

These objects are achieved by an injection method and apparatus in a hot chamber type die casting machine provided by the present invention.

According to the injection method of the present invention, an injection cylindrical body having one opened end connected to a sprue of a mold is crosswise brought into communication with a drawing-up cylindrical body stood with a lower opened end dipped into molten metal within a retaining furnace to form a cross-shape sleeve, said method comprising the drawing-up step of drawing-up and pouring molten metal within the retaining furnace into the injection cylindrical body through the drawing-up cylindrical body of the cross-shape sleeve and the injection step of injecting and filling the molten metal poured into the injection cylindrical body into a mold, whereby the molten metal within the retaining furnace is filled into the mold.

The injection apparatus is designed so that a drawing-up cylindrical body stood with a lower opened end dipped into molten metal within a retaining furnace and an injection cylindrical body having one opened end connected to a sprue of a mold are crosswise brought into communication with each other to form a cross-shape sleeve, drawing-up means for drawing-up and pouring molten metal within the retaining furnace into the injection cylindrical body is disposed on the upper opened end of the drawing-up cylindrical body of the cross-shape sleeve, and injection means for injecting and filling the molten metal poured into the injection cylindrical body is disposed on the other opened end of the injection cylindrical body.

DETAILED DESCRIPTION

Figure 1:
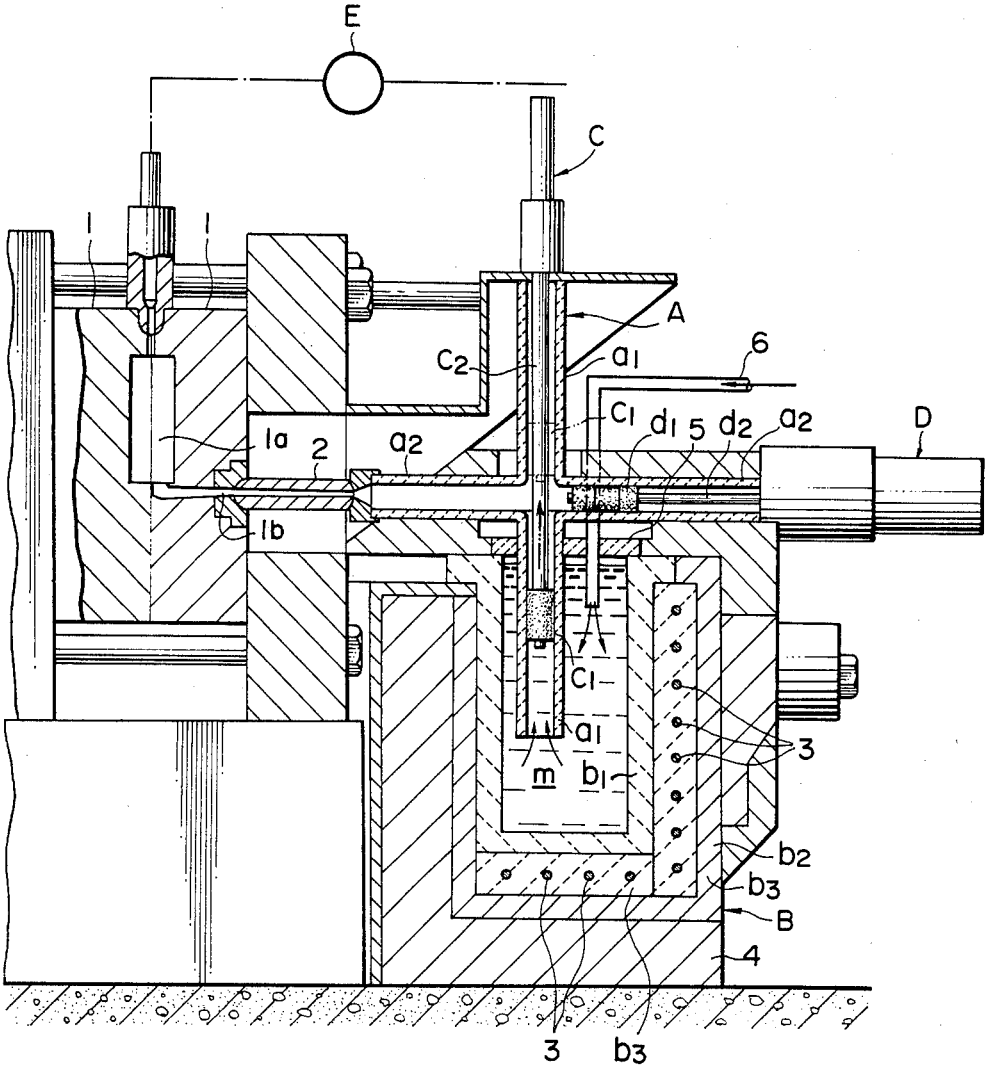
FIGS. 1 to 3 are respectively sectional views showing an embodiment of the present invention.

The embodiment will be described in connection with the drawings. Reference character A designates a cross-shape sleeve, and B a retaining furnace. Molten metal (m) within the retaining furnace B is once drawn up and removed outside the retaining furnace B, after which the molten metal is injected and filled into a mold 1 or a so-called cavity la.

The cross-shape sleeve A constitutes an injection flowpassage in which the molten metal (m) within the retaining furnace B is once drawn up and removed outside thw furnace B and then injected and filled into the cavity 1*a* of the mold 1. A drawing-up cylindrical body $a_1$ formed of ceramics and an injection cylindrical body $a_2$ are crosswise brought into communication and connection with each other to form an integral structure, a cylindrical portion on the lower opened portion of the drawing-up cylindrical body $a_1$ is dipped in midair into the molten metal (m) within the retaining furnace B and stood upright, and one open end of the injection cylindrical body $a_2$ is connected through a nozzle 2 to a sprue 1b of the mold and installed on the retaining furnace B.

A drawing-up cylinder C is stood upright above the upper open end of the drawing-up cylindrical body $a_1$ of the ceramics-made cross-shape sleeve A, and an injection cylinder D is horizontally arranged on the side of the other open end of the injection cylindrical body $a_2$.

The drawing-up cylinder C serves to draw-up and pour the molten metal (m), which entered the drawing-up cylindrical body $a_1$ dipped into the molten metal (m) within the retaining furnace B, into the injection cylindrical body $a_2$. A ceramics-made plunger tip $c_1$ stood upright on the drawing-up cylindrical body $a_1$ of the cross shape sleeve A and attached to the forward end of a rod $c_2$ thereof is slidably inserted into the drawing-up cylindrical body $a_1$.

The injection cylinder D serves to follow the drawing-up operation of the drawing-up cylinder C to inject and fill the molten metal, which is drawn up and poured into the injection cylindrical body $a_2$, into the mold 1. A ceramics-made plunger tip $d_1$ horizontally provided sideways of the other open end of the injection cylindrical body $a_2$ and attached to the forward end of a rod $d_2$ thereof is slidably inserted into the injection cylindrical body $a_2$.

It is noted that the drawing-up cylinder C and the injection cylinder D are brought into association with the die casting machine, whereby simultaneously with the termination of suction movement (upward movement) of the plugner tip $c_1$, the injection cylinder D is actuated accordingly to press and move forwardly the plunger tip $d_1$.

Figure 2:
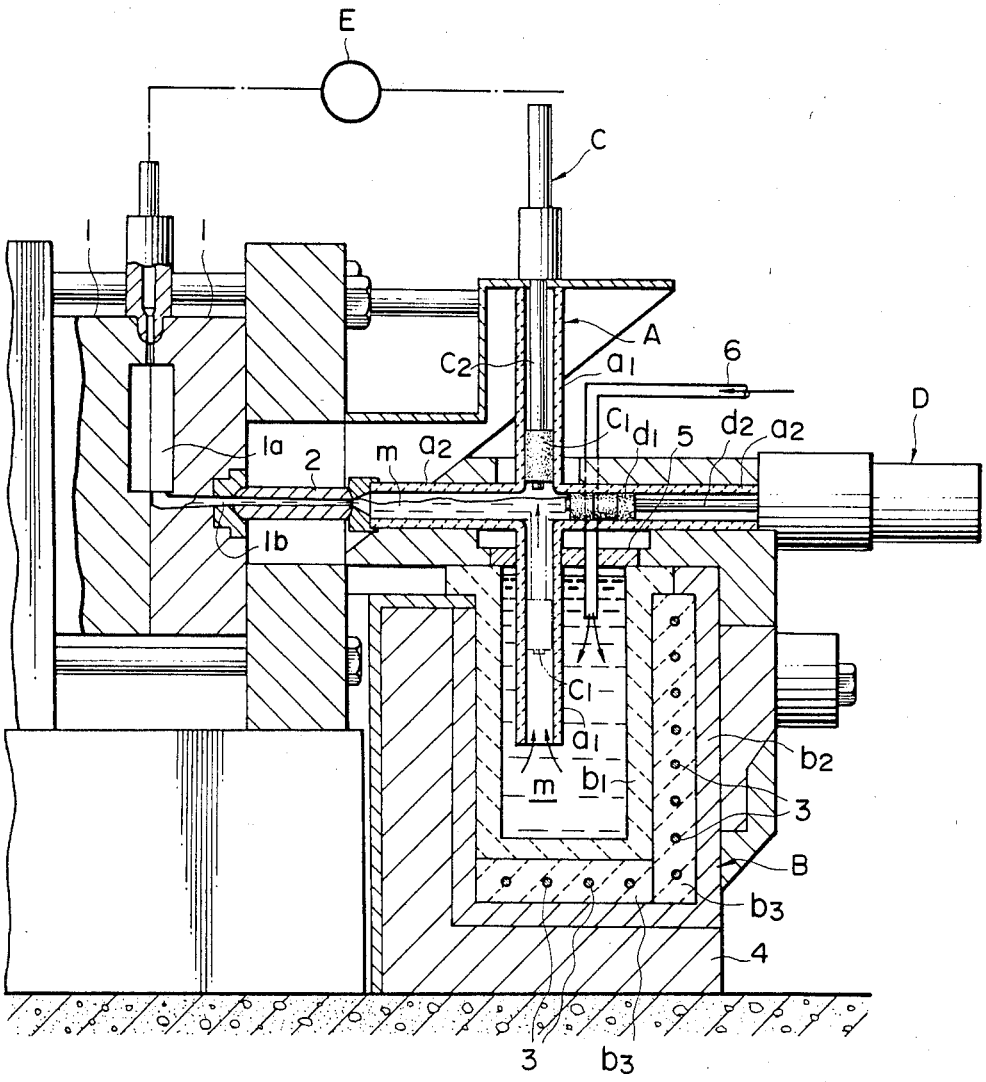
Figure 3:
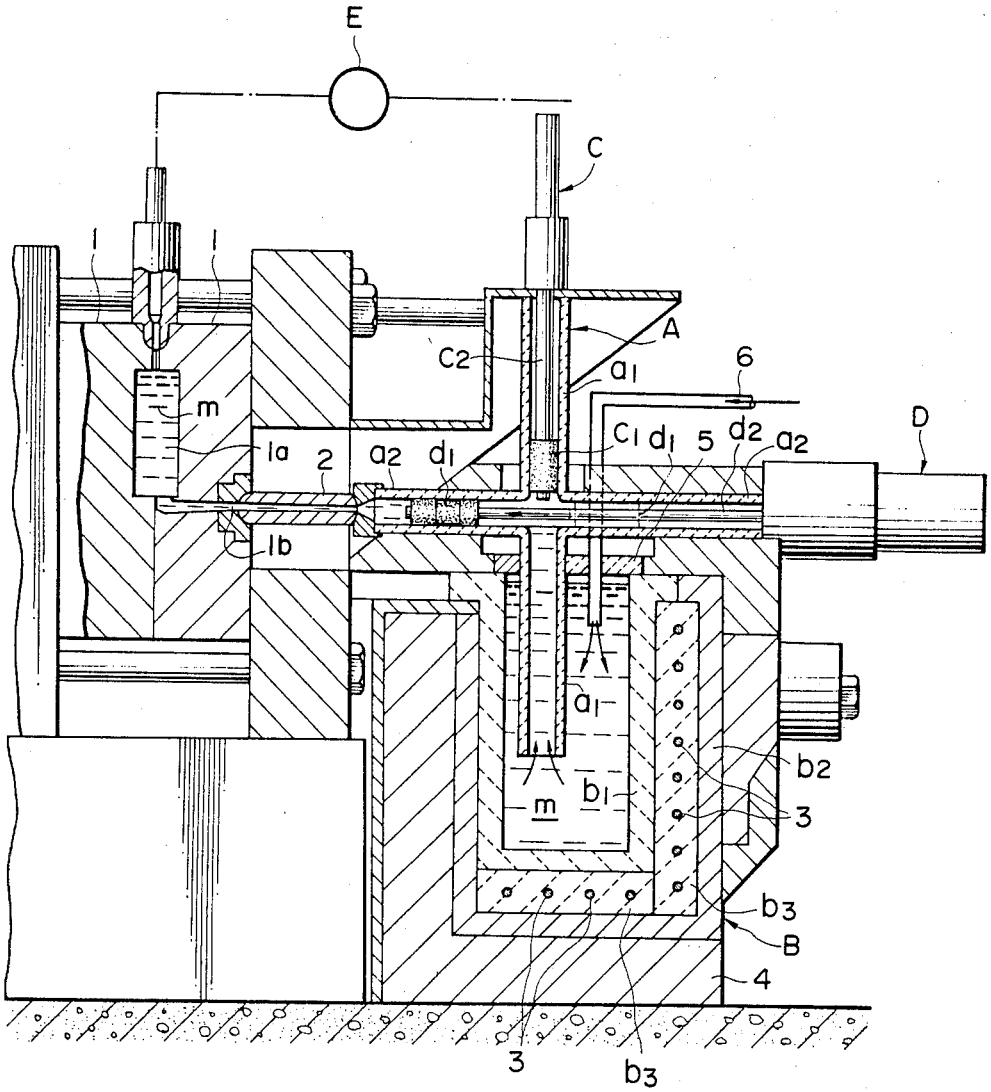

A series of injection operations will now be described. The plunger tip $c_1$ of the drawing-up cylinder C is allowed to wait at the down limit within the drawing-up cylindrical body $a_1$ of the cross shape sleeve A dipped in midair within the molten metal (m), and the plunger tip $d_1$ of the injection cylinder D is allowed to wait at the backward limit within the injection cylindrical body $a_2$ on the side of the cylinder D from a communicated intersection with the drawing-up cylindrical body $a_1$ (FIG. 1). In the injection stroke of the die casting machine in the casting cycle (every one cycle operation), the cylinder C is actuated to move forwardly the plunger tip $c_1$ to drawup and pour the molten metal (m) within the retaining furnace B into the injection cylindrical body $a_2$. Simultaneously when the plunger tip $c_1$ enters the drawing-up cylindrical body $a_2$ to assume its up limit (FIG. 2), the injection cylinder D is actuated to move forwardly the plunger tip $d_1$ to inject and fill the molten metal (m), which is drawn up and poured into the injection cylindrical body $a_2$, into the cavity 1*a* of the mold 1 through the nozzle 2 (FIG. 3).

Simultaneously when the plunger tip $d_2$ of the injection cylinder D is moved backward and returned to the backward limit, the plunger tip $c_1$ of the drawing-up cylinder C is moved forward and allowed to wait at the down limit for subsequent backward movement, and the aforementioned operation is again repeated to cooperate with the injection cylinder D thereby filling the molten metal (m) within the retaining furnace into the cavity 1*a* of the mold 1.

Accordingly, according to the present invention, there is provided an injection method wherein the molten metal (m) within the retaining furnace B is once removed outside the retaining furnace B by the cross shape sleeve A to inject and fill the molten metal into the cavity 1*a* of the mold 1. Therefore, the molten metal within the retaining furnace may be injected and filled into the mold without applying the shock and vibration from above to the retaining furnace. Thereby, there involves no possible metallic fatigue resulting from the shock and vibration on the inner walls of the heat retaining ladle and the suspended engaging portions of the ladle engaged at the upper portion of the machine frame as encountered in prior art, thus enabling to extend the life of the retaining furnace.

Furthermore, since the cross shape sleeve is formed of ceramics, excellent heat and shock resistance and durability are obtained and lubricating properties of the plunger tip to be reciprocated during injection may be improved.

Figure 4:
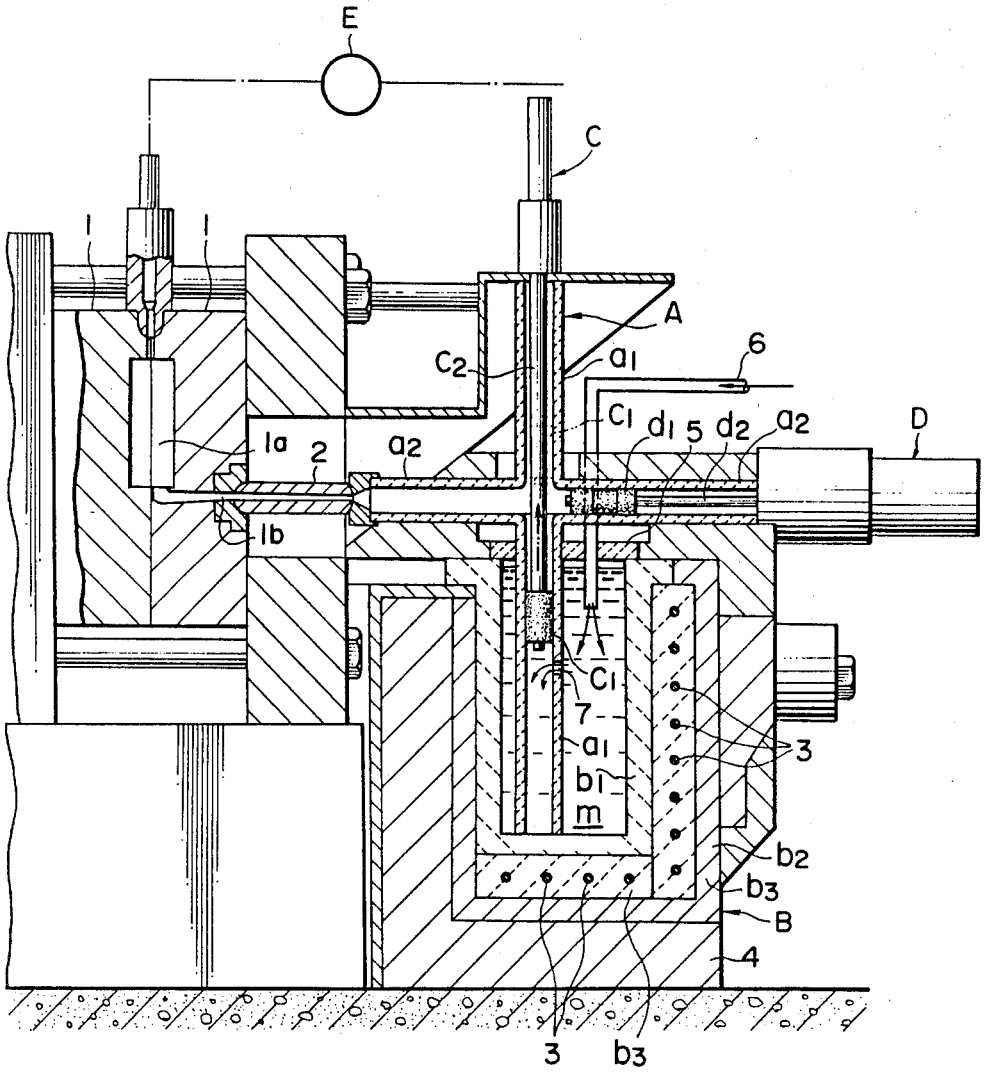
FIG. 4 is a sectional view showing an embodiment of the present invention.
Figure 5:
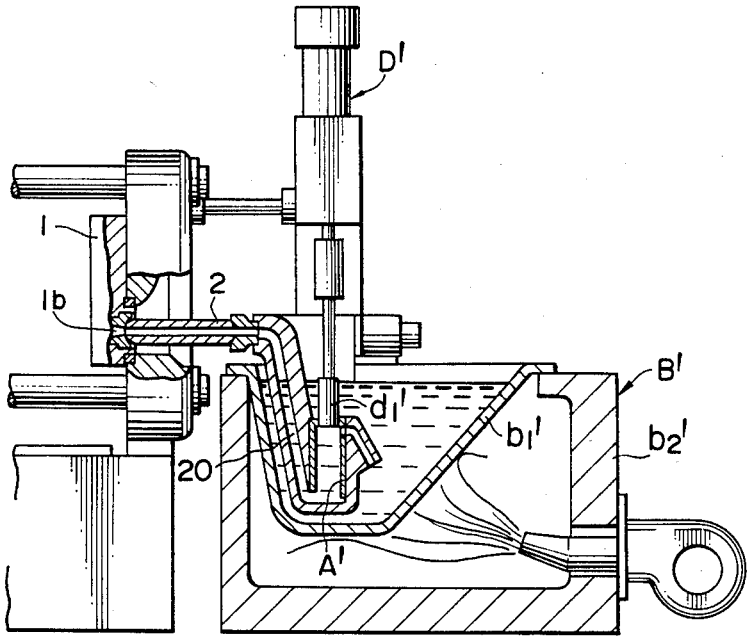
FIG. 5 PRIOR ART
FIG. 5 is a sectional view showing prior art.

In the above-described embodiment, a configuration of installment has been described in detail of the cross shape sleeve A with the drawing-up cylindrical body $a_1$ of the sleeve A dipped in midair within the molten metal (m) of the heat retaining furnace B. Alternatively, a configuration may be employed in which the drawing-up cylindrical body $a_1$, is directly placed on the furnace bottom with the lower open end of the drawing-up cylindrical body $a_1$ extended till the latter impinges upon the furnace bottom of the heat retaining furnace B. In this configuration, as shown in FIG. 4, an inlet hole 7 is formed in the drawing-up cylindrical body $a_1$ in the neighbourhood of the down limit where the plunger tip $c_1$ of the drawing-up cylinder C awaits so that the molten metal (m) may flow into the cylindrical body $a_1$.

In the configuration wherein the drawing-up cylindrical body $a_1$ of the cross shape sleeve A is directly placed on the furnace bottom, if the cross shape sleeve A is installed on the retaining furnace B, it is possible to stabilize the installing state of the cross shape sleeve A in a high temperature region of the molten metal (m).

Moreover, in the above-described embodiment, a configuration has been described in which the cross shape sleeve A is stood upright on the retaining furnace B with the drawing-up cylindrical body $a_1$ of the cross shape sleeve A stood vertically in midair. It would be however understood that a configuration may be included wherein the cross shape sleeve A is stood upright so that the drawing-up cylindrical body $a_1$ is obliquely positioned in midair having an angle of inclination as desired.

In the drawings, reference character E designates a suction device connected in communication with the cavity 1*a* of the mold 1, the suction device E being operatively connected to the die casting machine so that the device E is actuated simultaneously with the commencement of the drawing-up operation of the drawing-up cylinder C.

The retaining furnace B is constructed such that the ceramics-made heat retaining ladle $b_1$ is provided internally of the machine frame $b_2$ with a ceramics-made heat retaining material $b_3$ closely interposed between the outer surface of the ladle wall and the inner surface of the machine frame $b_2$.

The heat retaining ladle $b_1$ is generally cylindrically calcined with ceramics material having excellent shock resistance, heat and shock resistance and durability as well as high heat retaining properties, and the outer surface of the ladle wall, that is, the outer surface of the side wall and the lower surface of the bottom wall thereof are applied with the heat retaining material $b_3$.

The heat retaining material $b_3$ serves to always heat-retain the molten metal (m) stored within the heat retaining ladle $b_1$ to maintain it at a constant temperature. The heat retaining material $b_3$ has a heat generating member 3 embedded therein as a ceramics heating source having an excellent shock resistance, heat and shock resistance and durability and integrally calcined to have a thickness so that it may be closely interposed between the outer surface of the ladle wall and the inner surface of the machine frame $b_2$.

The heat retaining ladle $b_1$ and the machine frame $b_2$ are formed into an integral construction by the ceramicsmade heat retaining material $b_3$ closely registered with the outer surface of the ladle wall of the ceramics-made heat retaining ladle $b_1$ and closely registered with the inner surface of the machine frame $b_2$ to form the retaining furnace B construction which has the durability, is applied with the heat and shock resistance by the ceramics-made heat retaining ladle $b_1$, and with the shock resistance and high heat retaining properties by the heat retaining ladle $b_1$ and the ceramics-made heat retaining material $b_3$.

In the drawings, reference numeral 4 designates a rest on which the heat retaining furnace B is integrally mounted on the die casting machine, and 5 is a ceramicsmade cover for closing an opening of the heat retaining ladle $b_1$ to prevent the stored molten metal from oxidization, said cover 5 having a feed pipe 6 connected therethrough, said pipe being directly connected to a parent furnace such as a melting furnace, so that molten metal may be periodically supplied from the parent furnace.

As described above, the retaining furnace according to the present invention comprises an integrated construction wherein the heat retaining ladle and the machine frame are integrated by the ceramics-made heat retaining material closely registered with the outer surface of the ceramicsmade heat retaining ladle and closely registered with the inner surface of the machine frame, thus providing a retaining furnace construction which has the sufficient rigidity such as the shock resistance, heat and shock resistance and durability, which is free from a possible damage caused by the shock and vibration and the thermal shock during the use for a long period of time.

Furthermore, since the heat retaining ladle and heat retaining material is made of ceramics, a retaining furnace having excellent heat retaining properties is obtained to reduce the quantity of heat of molten metal released to the outside. Therefore, it is possible to prevent molten metal from a sudden lowering of temperature to maintain a constant temperature, thus enabling to cast products of high quality.

Next, the composition construction of ceramics of which the aforementioned cross shape sleeve A, the heat retaining ladle $b_1$, the heat retaining material $b_3$, and the plunger tips $c_1$ and $d_1$ are made will be briefly described.

This ceramics is a solid solution having a construction of $\alpha$-$Si_3N_4$, which comprises an $\alpha$-sialonic sintered material comprising a fine composite (solid solution) composition phase obtained by calcining 60 Vol % of a granular crystal ($\alpha$ phase) of $\alpha$-sialon represented by $M_x(Si, Al)_{12}(O,N)_{16}$(where M is Mg, Ca, Y) in 40 Vol % of a columnar crystal ($\beta$ phase) of $\beta$-$Si_3N_4$ and subjecting it to solid solution, which is excellent in mechanical properties such as strength, hardness, destruction and tenacity and is also excellent in heat and shock resistance and chemical resistance in the composition range called the region where the $\alpha$-sialon granular crystal 60 Vol % and $\beta$-$Si_3N_4$ columnar crystal 40 Vol % coexist, and the region of "partial stabilized" $\alpha$-sialon.

What is claimed is:

1. An injection method in a hot chamber type die casting machine of the type having an injection cylindrical body having one open end and connected to a sprue of a mold and a drawing-up cylindrical body in fluid communication with the injection cylindrical body and positioned crosswise thereto with a lower open end of the drawing-up cylindrical body dipped into molten metal within a retaining furnace to form a cross-shape sleeve, said method comprising the steps of:

slidably inserting a drawing-up plunger tip into the drawing-up cylindrical body;

drawing up the molten metal within the retaining furnace by reciprocable motion of said drawing-up plunger tip so as to pour the drawn-up molten metal into the injection cylindrical body through the drawing-up cylindrical body of the cross-shaped sleeve when said drawing-up plunger tip slides above said injection cylindrical body;

slidably inserting an injection plunger tip into the injection cylindrical body;

injecting the molten metal poured into the injection cylindrical body into a mold by reciprocable motion of said injection plunger tip so as to inject and fill the mold with the molten metal.

2. An injection apparatus in a hot chamber type die casting machine, comprising:

a drawing-up cylindrical body having a lower open end dipped into molten metal within a retaining furnace;

an injection cylindrical body having an open end connected to a sprue of a mold;

said injection cylindrical body and said drawing-up cylindrical body being in fluid communication and being positioned crosswise with respect to each other to form a cross-shape sleeve;

said cross-shape sleeve being formed as a single body made of a ceramic material having excellent heat and shock resistance characteristics so as to be capable of withstanding temperatures in the range of approximately 600° C. to 1,650° C.;

drawing-up means positioned on an upper open end of the drawing-up cylindrical body of the cross-shape sleeve for drawing up and pouring molten metal from the retaining furnace into the injection cylindrical body, said drawing-up means including a drawing-up plunger tip slidably and reciprocably inserted into said drawing-up cylindrical body for movement above said injection cylindrical body;

injection means positioned at an opposite open end of the injection cylindrical body for injecting and filling the poured molten metal into the injection cylindrical body, said injection means including an injection plunger tip slidably and reciprocally inserted into said injection cylindrical body.

3. The injection apparatus according to claim 11, wherein the retaining furnace is constructed such that a heat retaining ladle is a single body for storing molten metal and is calcined with a heat retaining ceramic having excellent heat and shock resistance characteristics so as to be capable of withstanding temperatures in the range of approximately 600° C. to 1,650° C., said ceramics-made heat retaining ladle being disposed within a machine frame, and a ceramics heat retaining material with a heat generating member embedded into the ceramics and integrally calcined is closely internally interposed between an inner surface of the machine frame and an outer surface of the heat retaining ladle.

4. The injection apparatus according to claim 2, wherein the cross-shape sleeved is installed with the drawing-up cylindrical body thereof dipped into molten metal in the retaining furnace while being directly placed on the furnace bottom of the retaining furnace, and an inlet hole for receiving the molten metal into said cylindrical body is formed in the drawing-up cylindrical body of said sleeve.

5. The injection apparatus according to claim 2, wherein the ceramic comprises a solid solution having a construction of $\alpha$-$Si_3N_4$, which is an $\alpha$-sialonic sintered material comprising a fine composite composition phase called a "partial stabilized" $\alpha$-sialon region where 60 Vol % of $\alpha$-sialon granular crystal represented by $M_x(Si, Al)_{12}(O,N)_{16}$(where M is Mg, Ca, Y, etc.) and 40 Vol % of $\beta$-$Si_3N_4$ columnar crystal coexist.

* * * * *